US012415127B2

(12) United States Patent
Dempsey et al.

(10) Patent No.: US 12,415,127 B2
(45) Date of Patent: Sep. 16, 2025

(54) TACTILE BRAILLE DICE

(71) Applicant: DOTS RPG Project Foundation, East Northport, NY (US)

(72) Inventors: Jessica Dempsey, Bay Shore, NY (US); Joseph Iovino, East Northport, NY (US)

(73) Assignee: DOTS RPG Project Foundation, East Northport, NY (US)

( * ) Notice: Subject to any disclaimer, the term of this patent is extended or adjusted under 35 U.S.C. 154(b) by 775 days.

(21) Appl. No.: 17/741,511

(22) Filed: May 11, 2022

(65) Prior Publication Data

US 2022/0395745 A1 Dec. 15, 2022

Related U.S. Application Data

(60) Provisional application No. 63/208,546, filed on Jun. 9, 2021.

(51) Int. Cl.
*A63F 9/04* (2006.01)

(52) U.S. Cl.
CPC .... *A63F 9/0415* (2013.01); *A63F 2009/0422* (2013.01); *A63F 2009/0426* (2013.01); *A63F 2009/0431* (2013.01); *A63F 2009/0435* (2013.01); *A63F 2009/0437* (2013.01); *A63F 2009/0446* (2013.01)

(58) Field of Classification Search
CPC ..... A63F 9/04; A63F 9/0413; A63F 9/0415; A63F 2009/0042; A63F 2009/0422; A63F 2009/0424; A63F 2009/0426; A63F 2009/0428; A63F 2009/0431; A63F 2009/0433; A63F 2009/0435; A63F 2009/0437; A63F 2009/044; A63F 2009/0444; A63F 2009/0446; A63F 2009/0448; A63F 2009/0451; A63F 2009/0453; A63F 2009/0455; A63F 2009/0457; A63F 2009/0459; A63F 2009/0488
USPC ..... 273/146
See application file for complete search history.

(56) References Cited

U.S. PATENT DOCUMENTS 3,931,971 A * 1/1976 Harvey ..... A63F 9/0278 473/610
4,461,483 A * 7/1984 Kopp ..... A63F 1/04 273/293
5,152,690 A * 10/1992 Todd ..... G09B 21/003 434/117
5,275,567 A * 1/1994 Whitfield ..... G09B 21/003 434/112

(Continued)

FOREIGN PATENT DOCUMENTS

DE 2907553 A1 8/1980
TW M478667 U 5/2014

*Primary Examiner* — Joseph B Baldori
(74) *Attorney, Agent, or Firm* — Anna-Lisa L. Gallo; Tyler A. Stevenson

(57) ABSTRACT

A tactile die for playing a game, the die comprising a plurality of sides, wherein each side comprises a face having a braille character, each side comprises 3 or more raised border edges surrounding the face, and wherein one of the 3 or more raised border edges is an indicator edge configured to indicate an orientation of the face, the indicator edge comprising an indent along a length thereof.

19 Claims, 8 Drawing Sheets

(56) References Cited

U.S. PATENT DOCUMENTS

| | | | | |
|---|---|---|---|---|
| 5,839,725 | A * | 11/1998 | Conway | A63F 3/00028 273/277 |
| 6,547,244 | B2 * | 4/2003 | Connelly | A63F 3/00006 273/DIG. 27 |
| 6,752,393 | B2 * | 6/2004 | DiGirolamo | A63F 9/04 273/430 |
| 7,614,881 | B2 * | 11/2009 | Bagues | G09B 1/16 434/188 |
| 8,545,227 | B2 * | 10/2013 | Downs | A63F 9/04 273/272 |
| 8,678,388 | B2 * | 3/2014 | Nagy | A63F 9/0413 273/146 |
| 11,219,818 | B1 * | 1/2022 | Yakos | A63F 9/0413 |
| D1,033,547 | S * | 7/2024 | Whitmyre | D21/373 |
| 2011/0275038 | A1 * | 11/2011 | Penner | G09B 23/02 434/188 |
| 2019/0105556 | A1 * | 4/2019 | Blazakis | A63F 3/00895 |
| 2022/0379193 | A1 * | 12/2022 | Ankner | A63F 9/04 |

* cited by examiner

100

100

100

100

100

100

TACTILE BRAILLE DICE

The invention is directed towards dice for game playing, the dice configured for use by those having limited or no sight.

BACKGROUND

Certain games, for example role-playing games like Dungeons & Dragons, employ polyhedral dice. Braille dice may be required for those having limited or no sight. Desired are dice for game playing that are easily read via touch, are comfortable to hold and pleasant to touch, are stable when resting on a side, and are of a proper size.

SUMMARY

Accordingly, A tactile die for playing a game, the die comprising a plurality of sides, wherein each side comprises a face having a braille character, each side comprises 3 or more raised border edges surrounding the face, and wherein one of the 3 or more raised border edges is an indicator edge configured to indicate an orientation of the face, the indicator edge comprising an indent along a length thereof.

Also disclosed is a set of tactile dice comprising at least two different die as described, the set comprising die having 4, 6, 8, 10, 10, 12, or 20 sides.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

Figure 1A:
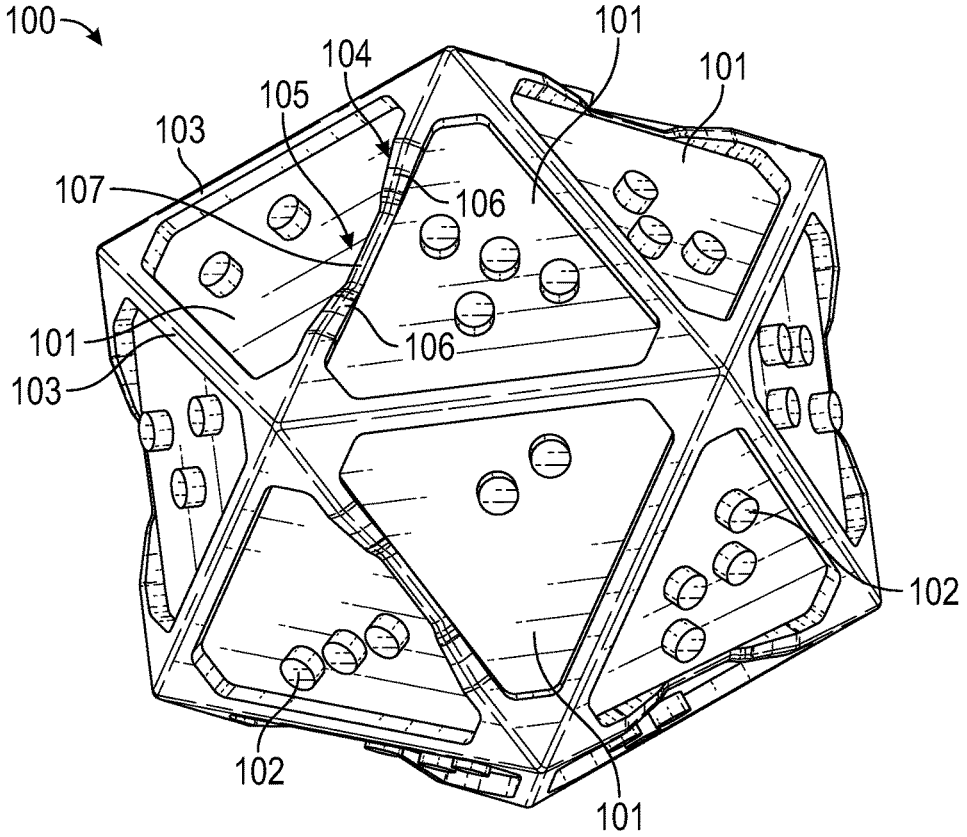
FIG. 1A-FIG. 1J show a front, top, left side perspective view, a front view, a rear view, a left side view, a right side view, a top view, a bottom view, a front, top, right side perspective view, a rear, bottom, left side perspective view, and a rear, bottom, right side perspective view of a 20-sided die, respectively, according to some embodiments.

FIG. 1A shows a perspective view of 20-sided icosahedron die 100, according to some embodiments. Die 100 comprises 20 faces 101. When rolled, die 100 will come to rest on a single face, and a single opposite face, the face to be read, will face straight up. Each triangular face 101 comprises braille characters 102, and raised border edges 103 and 104. Raised border edge 104 is an indicator edge, comprising indent 105 along a length thereof. Border edge 104 comprises smooth downward-sloped edges 106, which slope down to lowest point 107, about flush with faces 101. Characters 102 fit neatly in faces 101, comprising no number-indicating "pound" sign (as traditionally found in braille numbering).

Figure 1B:
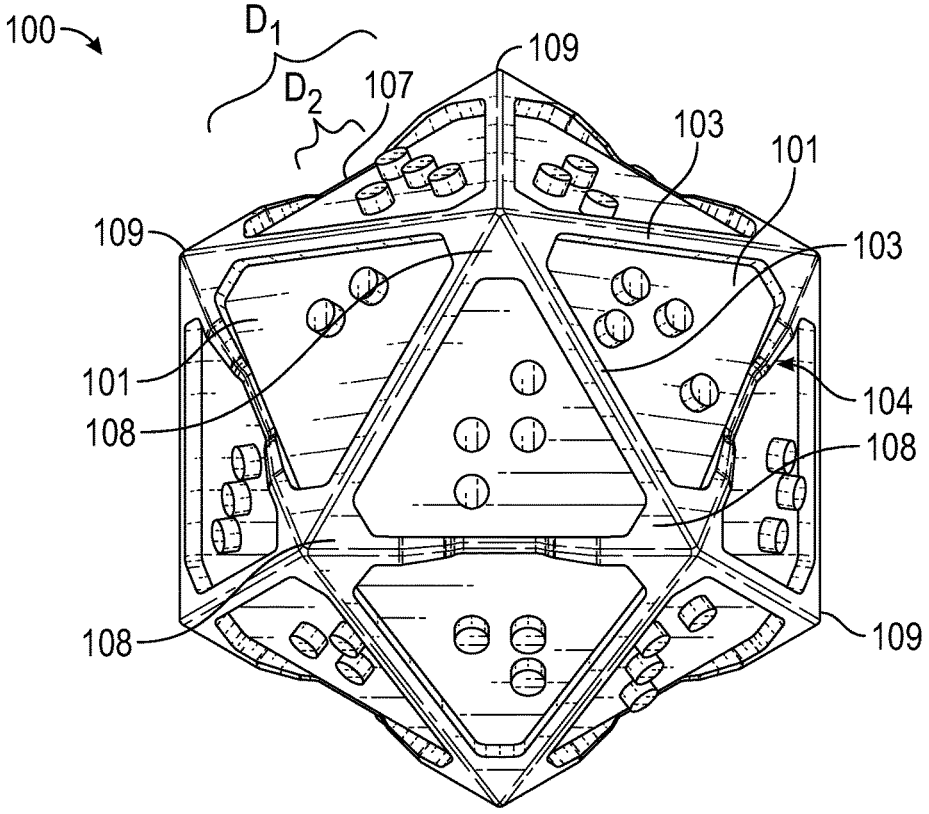
Figure 1C:
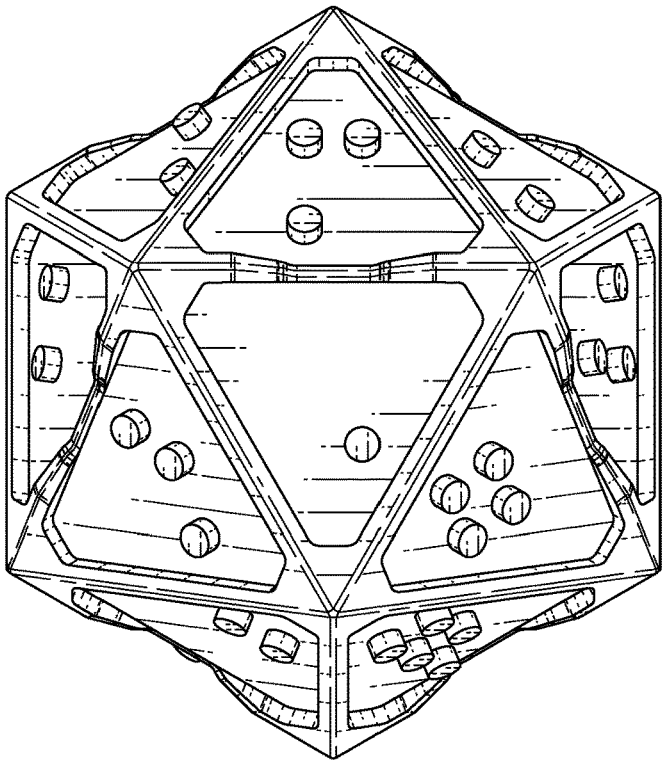
Figure 1D:
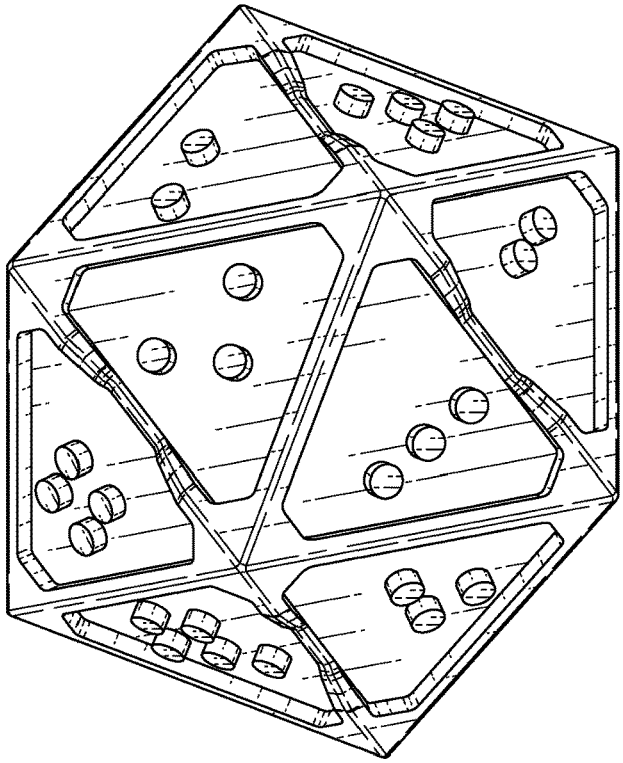
Figure 1E:
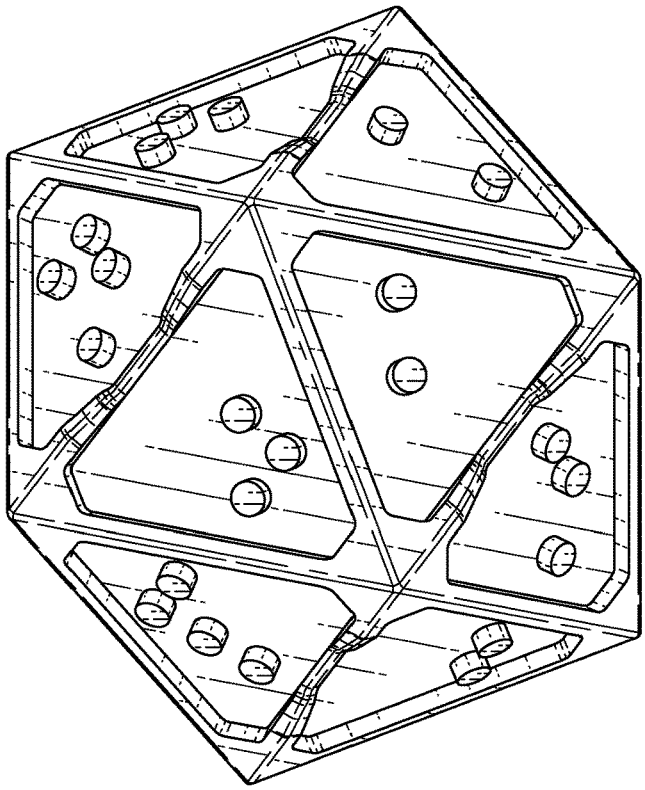
Figure 1F:
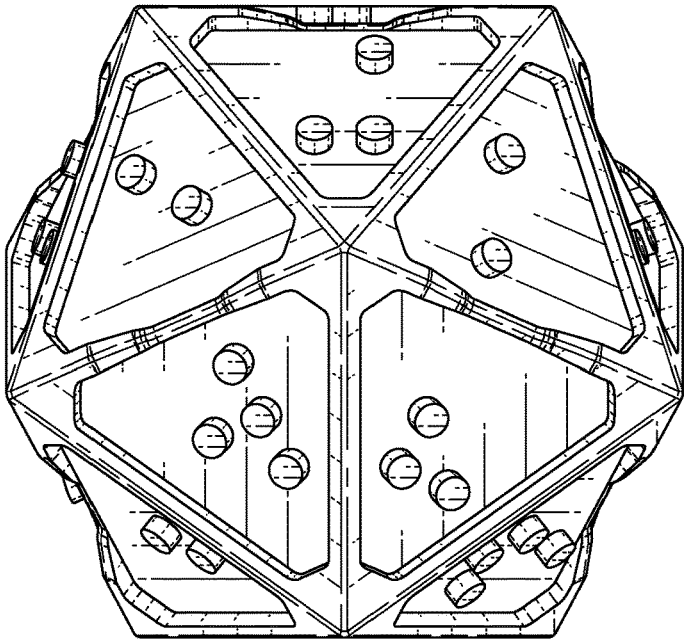
Figure 1G:
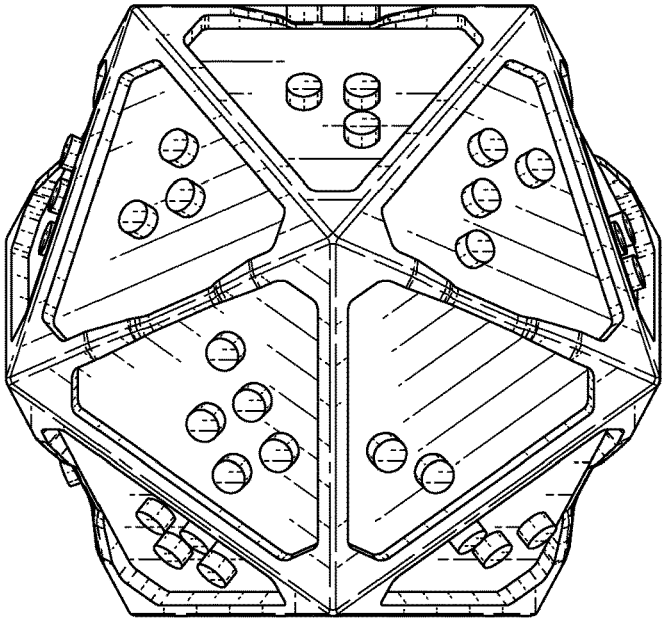
Figure 1H:
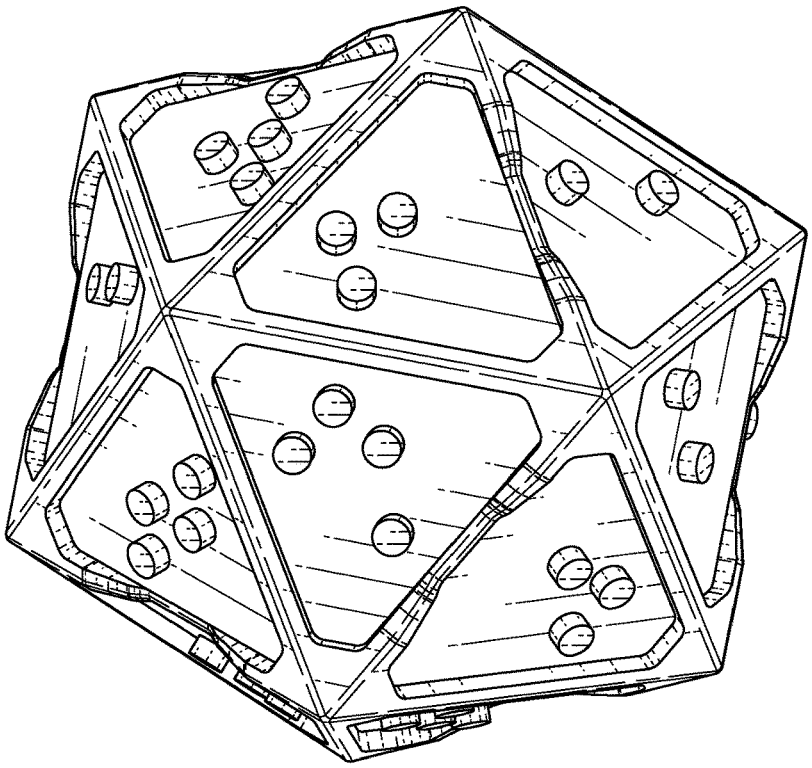
Figure 1I:
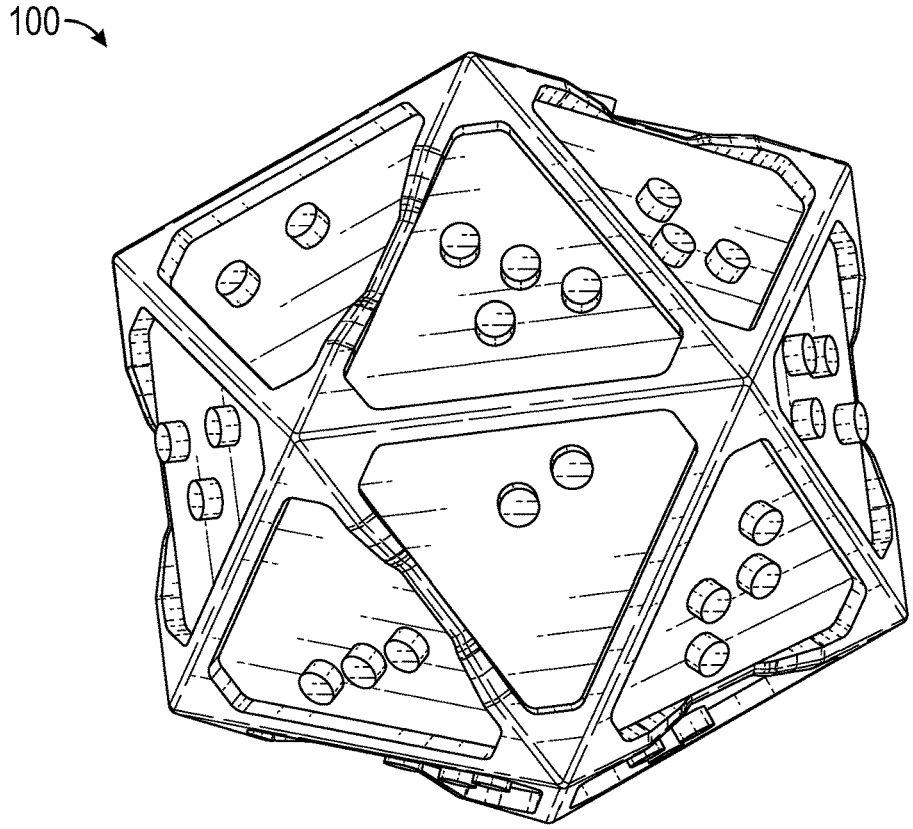
Figure 1J:
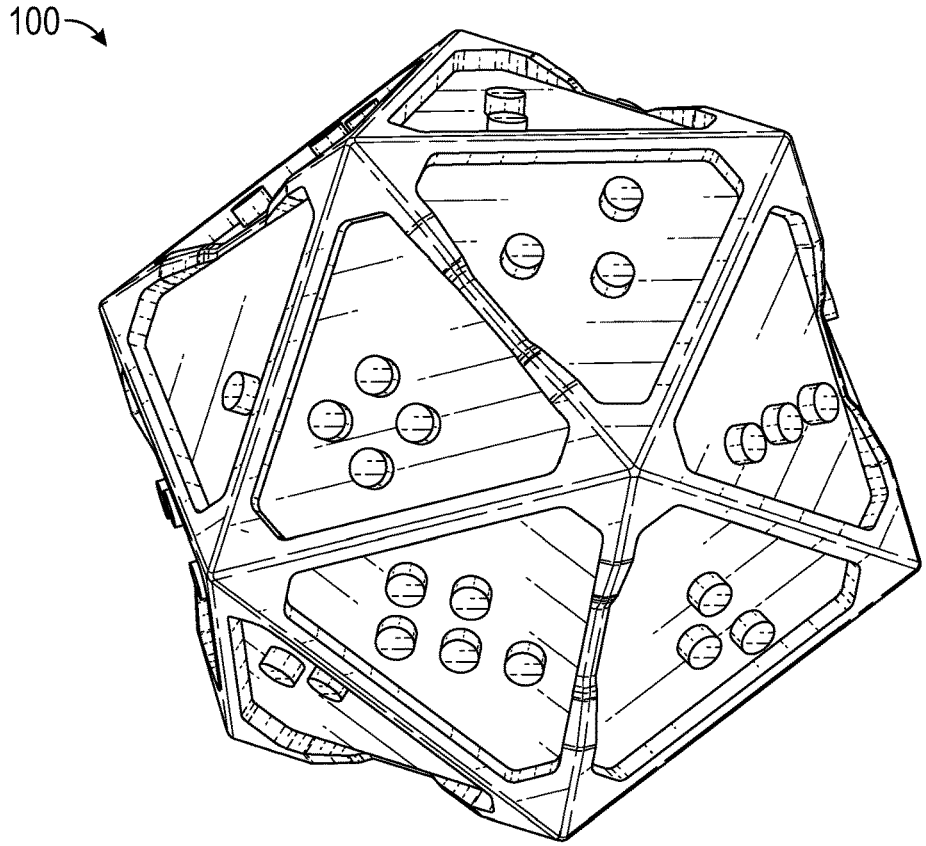

FIG. 1B shows a front view of 20-sided icosahedron die 100, according to an embodiment. A distance D1 between points of indent 105 where it begins to slope down to low point 107, comprises about 52% of the entire length of an edge from corner 109 to corner 109. A distance D2 of a length of low point 107 is about 18% of the entire length from corner 109 to corner 109, or about 33% of D1. Raised border edges 103 and 104 meet at corners 109. Corners 109 have a substantially identical size and shape. Corners 109 have increased surface areas 108, which are small enough not to crowd braille characters 102 and which provide for stability when die 100 is at rest on a face. An increased surface area 108 may be indicated for example, where a triangular face comprises rounded corners as in FIG. 1B. FIG. 1C through FIG. 1J provide further views of die 100.

Figure 2:
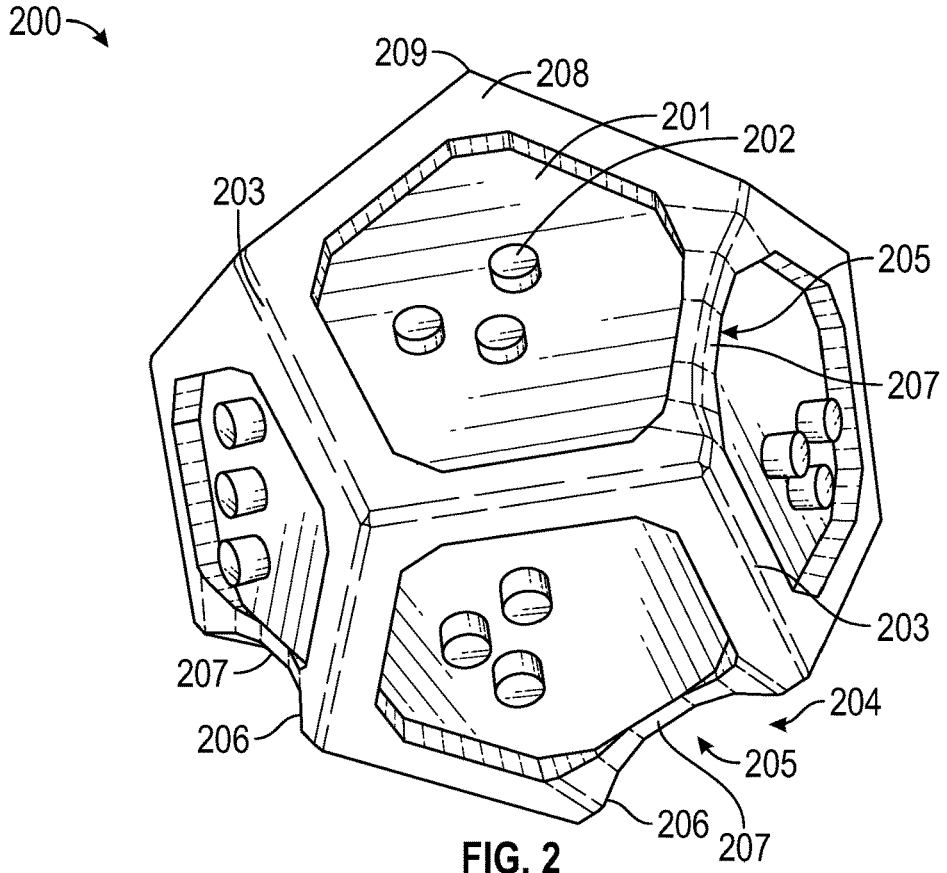
FIG. 2 shows a 12-sided die, according to an embodiment.

FIG. 2 shows 12-sided dodecahedron die 200, according to an embodiment. Die 200 comprises 12 faces 201, braille characters 202, and raised border edges 203 and 204. Indicator border edges 204 comprise indents 205. Corners 209 comprise increased surface areas 208 which take up some surface area from pentagonal faces 201.

Figure 3A:
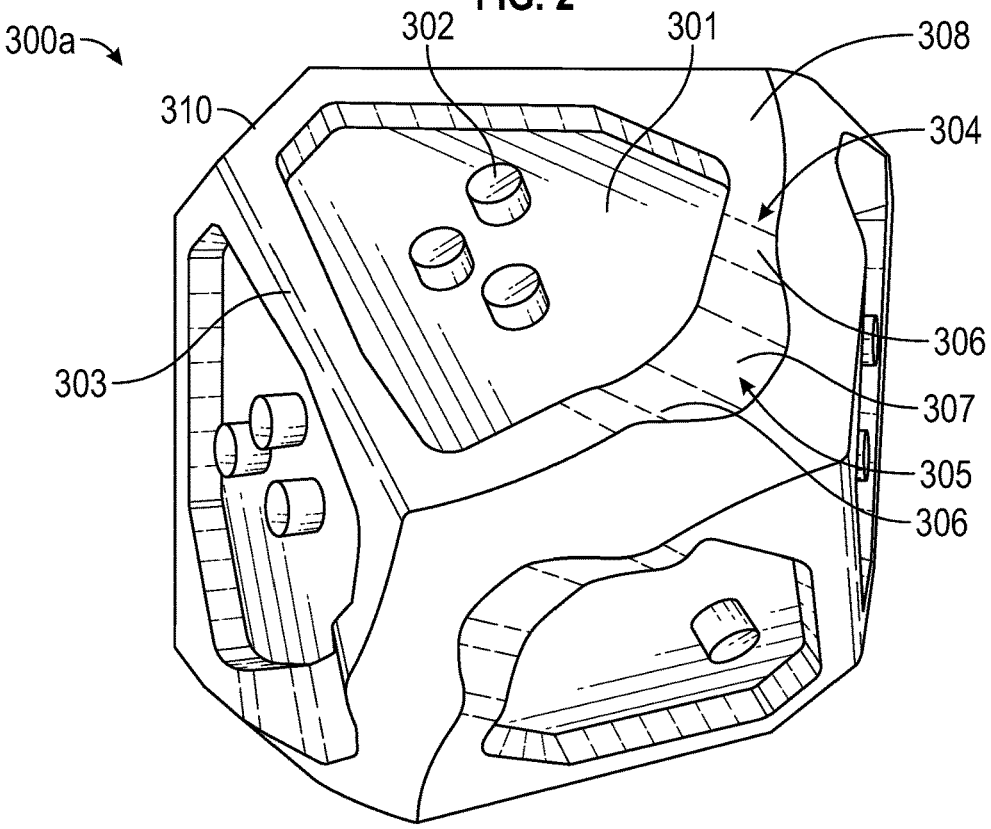
FIG. 3A and FIG. 3B show different 10-sided die, according to some embodiments.
Figure 3B:
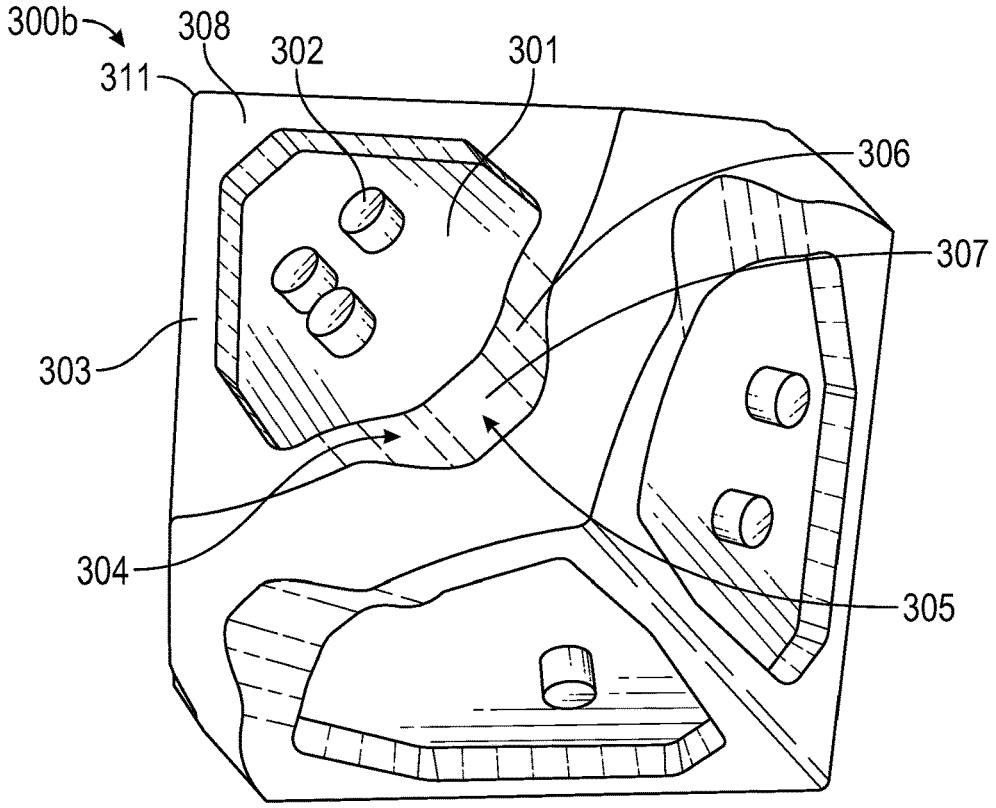

FIG. 3A and FIG. 3B show different 10-sided pentagonal trapezohedron die 300*a* and 300*b*, according to some embodiments. Die 300*a* and 300*b* comprise 10 faces 301, braille characters 302, and raised border edges 303 and 304. Indicator edges 304 are not linear, but bent or curved. Raised border edges 303, like other border edges shown in the figures, are linear. Each side shares part of an indicator edge 304 with two other sides. Die 300*a* comprises blunted corners 310, while die 300*b* comprises sharp corners 311, thus differentiating the two die. Scoop 305 is centered along edges 304.

Figure 4:
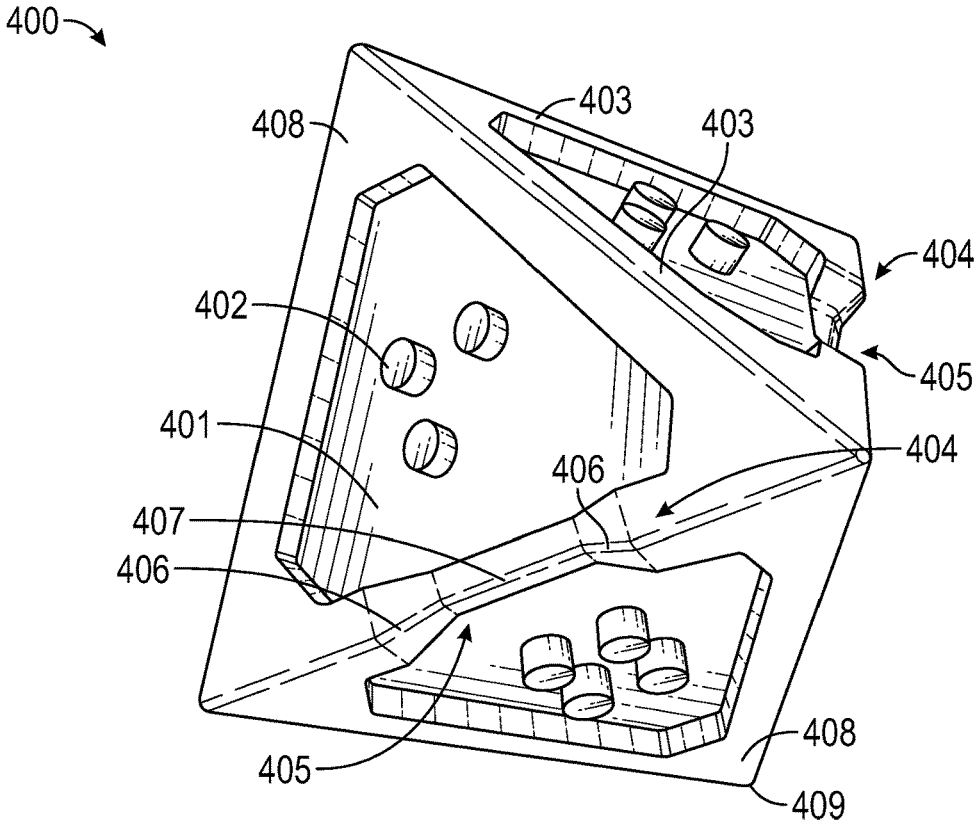
FIG. 4 shows an 8-sided die, according to an embodiment.

FIG. 4 shows 8-sided octahedron die 400, according to an embodiment. Die 400 comprises 8 faces 401, braille characters 402, and raised border edges 403 and 404. Indicator border edges 404 comprise indents or scoops 405. Each triangular side comprises 2 raised edges 403 and one indicator edge 404. Every side shares an indicator edge 404. Corners 409 comprise increased surface areas 408, taking up some surface area of triangular faces 401.

Figure 5:
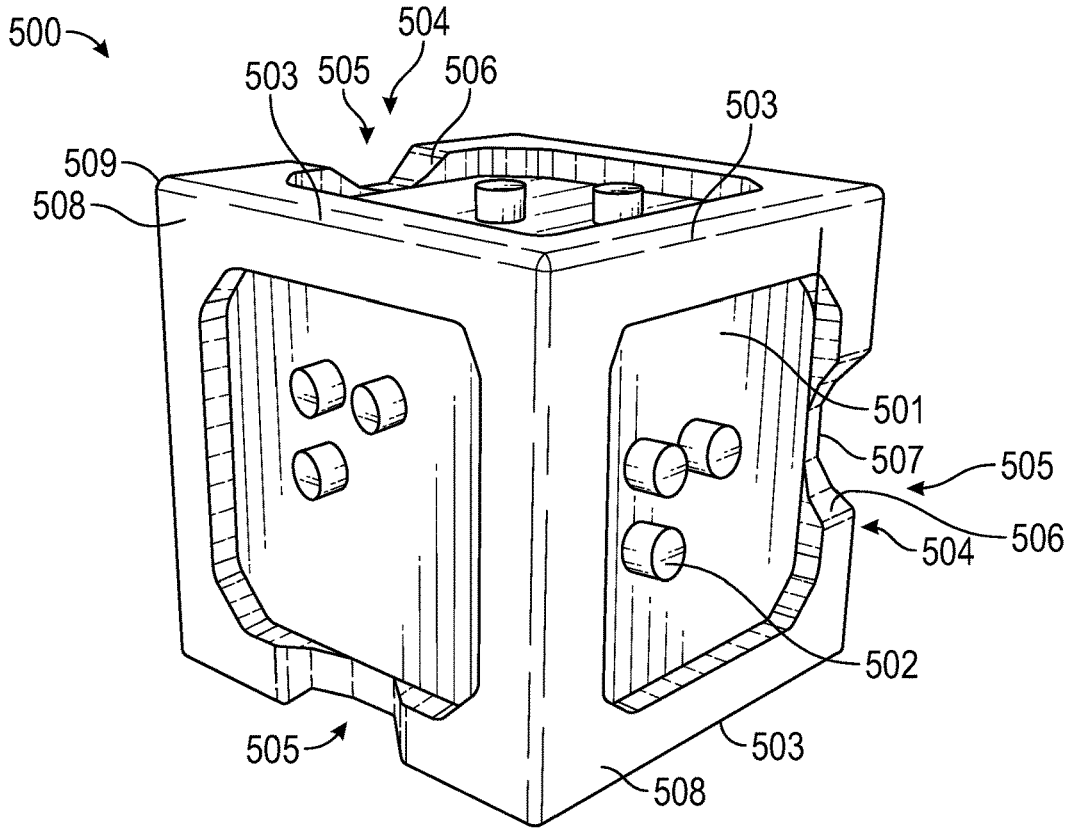
FIG. 5 shows a 6-sided die, according to an embodiment.

FIG. 5 shows 6-sided cube die 500, according to an embodiment. Die 500 comprises 6 faces 501, braille characters 502, and raised border edges 503 and 504. Indicator edges 504 comprise indents or scoops 505. Each square side comprises 3 edges 503 and one indicator edge 504. Each side shares an indicator edge 504. Corners 509 comprise increased surface areas 508, taking up some surface area of square faces 501.

Figure 6:
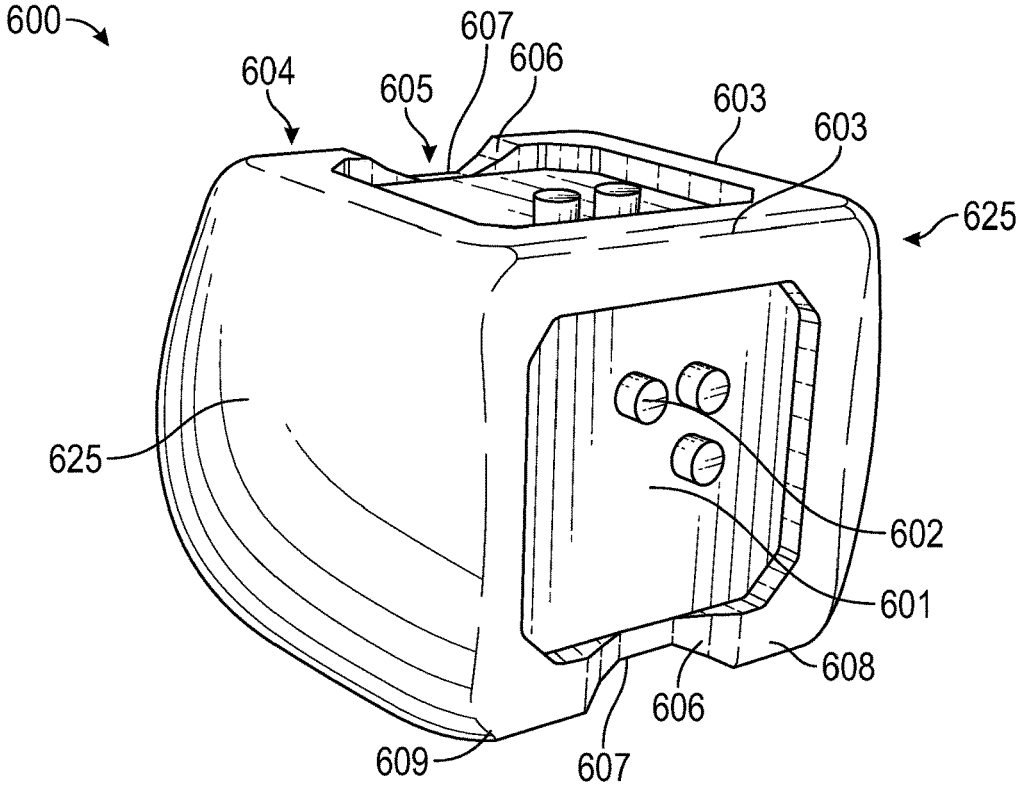
FIG. 6 shows a 4-sided die, according to an embodiment.

FIG. 6 shows 4-sided die 600, according to an embodiment. Die 600 comprises 4 faces 601, braille characters 602, and raised border edges 603 and 604. Indicator edges 604 comprise indents or scoops 605. Each rectangular side comprises 3 edges 603 and one indicator edge 604. Each side shares an indicator edge 604. Corners 609 comprise increased surface areas 608, taking up some surface area of rectangular faces 601. Four-sided die 600 contains two rounded, dome-shaped sides 625 having no characters. Sides 625 are opposite each other.

Following are indicator numbers of features in the figures.

100 200 300*a* 300*b* 400 500 600 die

101 201 301 401 501 601 die face

102 202 302 402 502 602 braille characters

103 203 303 403 503 603 raised border edge

104 204 304 404 504 604 raised border edge—indicator edge

105 205 305 405 505 605 edge indent

106 206 306 406 506 606 downward slope of edge

107 207 307 407 507 607 indicator edge low point
108 208 308 408 508 608 corner increased surface area
109 209 409 509 609 corner
625 rounded side
310 blunted corner
311 sharp corner In some embodiments, an indent positioned along a length of a raised indicator edge may be substantially centered along a length of the edge. In other embodiments, an indent may be positioned off-center along a length of the edge. An indent may be a notch having any shape, for instance a triangular, rectangular, square, arc shape, etc. In some embodiments, an indent may be referred to as a "scoop" or a "divot". An indent may have sharp edges and/or corners. In other embodiments, an indent may have smooth edges. In some embodiments, an indent may have smooth, downward-sloped edges, which slope down to a lowest point. In some embodiments, a lowest point may be flush or about flush with a face surface. In other embodiments, a lowest point may be positioned at a point above a face surface.

A face is generally planar and contains braille characters. A face is bordered by raised border edges, wherein one or more of the raised edges are indicator edges. In general, a side will comprise a single indicator edge. In some cases, a side (a minority of sides) will contain only indicator edges (thus not being indicator edges). In some embodiments, all edges are generally linear. In other embodiments, some edges may be non-linear, for example bent or curved. In some embodiments, an indicator edge may be bent or curved.

In some embodiments, an indicator edge may comprise a single indent. In other embodiments, an indicator edge may comprise 2, 3, 4, or more indents. In some embodiments, two sides of a die may share a single indicator edge. An indicator edge allows one to determine an orientation of a die, for example may indicate which way is up, for example how to read a 6 vs. 9.

In an embodiment, the present braille characters are configured to be interpreted as numbers. Typically, braille characters to be interpreted as numbers use letters A-J to represent numbers 1-10, and are preceded by a "pound" symbol to indicate it should be read as a number. For example "#AH" would indicate the number 18, #C would indicate 3, etc. In some embodiments, present braille characters employ no "pound symbol", and may simply use a corresponding alphabet letter to indicate a number. For example, S may represent 19, P may represent 16, C may represent 3, etc. A present number indicating system may allow for more space on a die side, thus allowing for corners having increased surface area.

In some embodiments, an indent, notch, or scoop may comprise a length of from any of about 3.0 mm, about 3.5 mm, about 4.0 mm, about 4.5 mm, about 5.0 mm, about 5.5 mm, about 6.0 mm, or about 6.5, mm, to any of about 7.0 mm, about 7.5 mm, about 8.0 mm, about 8.5 mm, about 9.0 mm, about 9.5 mm, about 10.0 mm, about 10.5 mm, about 11.0 mm, or more, measured from inflection points where the indent begins to angle downwards, along a length of an edge.

In some embodiments, an indent, notch, or scoop length, measured between inflection points, may make up from any of about 15%, about 18%, about 20%, about 23%, about 26%, about 29%, about 32%, or about 35%, to any of about 38%, about 41%, about 44%, about 47%, or more, of an entire length of an edge from corner to corner.

In some embodiments, a length of an indent, notch, or scoop low point may comprise a length of from any of about 0.5 mm, about 1.0 mm, about 1.3 mm, about 1.6 mm, about 1.9 mm, or about 2.2 mm, to any of about 2.5 mm, about 2.8 mm, about 3.1 mm, about 3.4 mm, about 3.7 mm, about 4.0 mm, about 4.3 mm, about 4.7 mm, about 5.0 mm, about 5.3 mm, about 5.6 mm, about 5.9 mm, about 6.2 mm, about 6.5 mm, about 6.8 mm, or more, measured along a low point edge surface.

In some embodiments, a length of an indent, notch, or scoop low point, measured along a low point edge surface, may make up from any of about 10%, about 13%, about 16%, about 19%, about 22%, or about 25%, to any of about 28%, about 31%, about 34%, about 37%, or more, of an entire length of an edge from corner to corner.

In some embodiments, a height of a braille character from a face may be about the same as a height of a border edge. In other embodiments, a braille character height may be slightly less than a height of a border edge. In some embodiments, a braille character height may be from about 40%, about 45%, or about 50%, to any of about 55%, about 60%, about 65%, about 70%, about 75%, about 80%, about 85%, about 90%, about 95%, or about 100% of the height of a border edge.

In some embodiments, a die side comprises a die face and border edges surrounding the face. Upon rolling a die, it may come to rest on raised edges. In some embodiments, an increased corner surface area provides for increased stability when a die is at rest on its edges.

It has been found that present die are comfortable to the touch, are easy to read, and are stable when at rest on a side thereof.

The term "adjacent" may mean "near" or "close-by" or "next to".

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A tactile die for playing a game, the die comprising a plurality of sides, wherein each side comprises a face to be read having a braille character, each side comprises 3 or more raised border edges surrounding the face, upon being rolled, the die is configured to rest on the raised border edges, the die will rest on a single side, and a single opposite side comprising the face to be read will face straight up, and a single one of the 3 or more raised border edges surrounding each face is an indicator edge configured to indicate an orientation of the face to be read, the indicator edge comprising an indent along a length thereof.

2. The tactile die according to claim 1, wherein the braille character is configured to be read as a number.

3. The tactile die according to claim 2, wherein the braille character is not preceded by a number-indicating pound sign.

4. The tactile die according to claim 1, wherein the indent is substantially centered along a length of the raised border edge.

5. The tactile die according to claim 1, wherein the indent comprises smooth downward-sloped edges.

6. The tactile die according to claim 1, wherein a lowest point of the indent is flush or about flush with the face.

7. The tactile die according to claim 1, wherein any two sides share the single indicator edge.

8. The tactile die according to claim 1, comprising 4, 6, 8, 10, 12, or 20 sides.

9. The tactile die according to claim 1, wherein the indicator edges are non-linear.

10. The tactile die according to claim 1, wherein each side comprises 3 raised border edges and a single indicator edge.

11. The tactile die according to claim 1, wherein each side comprises 4 raised border edges and a single indicator edge.

12. The tactile die according to claim 1, wherein each side comprises 5 raised border edges and a single indicator edge.

13. The tactile die according to claim 1, wherein the raised border edges meet at corners, and wherein the corners have an increased surface area.

14. The tactile die according to claim 1, wherein the raised border edges meet at corners, and wherein the corners are substantially identical in shape.

15. The tactile die according to claim 1, wherein the indicator edges are linear.

16. A set of tactile dice comprising at least two different die according to claim 1, the set comprising die having 4, 6, 8, 10, 12, or 20 sides.

17. The set of tactile dice according to claim 16, comprising 7 different die having 4, 6, 8, 10, 10, 12, and 20 sides.

18. The set of tactile die according to claim 17, wherein the two different die having 10 sides are differentiated by their corners.

19. The set of tactile die according to claim 18, wherein one of the two die having 10 faces comprises blunted corners.

* * * * *